United States Patent [19]

Stevens

[11] 4,082,274

[45] Apr. 4, 1978

[54] TENNIS RACKET

[76] Inventor: Robert Stevens, 552 Glorietta Ave., Newport Beach, Calif. 92660

[21] Appl. No.: 698,523

[22] Filed: Jun. 22, 1976

[51] Int. Cl.[2] ..... A63B 49/02

[52] U.S. Cl. ..... 273/73 C

[58] Field of Search ..... 273/73 R, 73 C, 73 D, 273/73 F, 73 G, 73 H, 73 J, 73 K, DIG. 7, DIG. 23

[56] References Cited

U.S. PATENT DOCUMENTS

| | | | |
|---|---|---|---|
| 1,173,588 | 2/1916 | Larocque | 273/73 H |
| 1,556,558 | 10/1925 | Gower et al. | 273/73 H |
| 1,587,918 | 6/1926 | Morrison | 273/73 C X |
| 1,750,727 | 3/1930 | Norton | 273/73 H |
| 2,164,631 | 7/1939 | Abell | 273/73 H |
| 2,224,567 | 12/1940 | Reach | 273/73 C |
| 3,083,968 | 4/1963 | Takahashi | 273/73 R |
| 3,787,051 | 1/1974 | Johns | 273/73 F |
| 3,810,620 | 5/1974 | Decker et al. | 273/73 C X |

FOREIGN PATENT DOCUMENTS

| | | | |
|---|---|---|---|
| 208,945 | 7/1957 | Australia | 273/73 C |
| 107,660 | 7/1917 | United Kingdom | 273/73 H |
| 201,245 | 7/1923 | United Kingdom | 273/73 H |
| 695,064 | 8/1953 | United Kingdom | 273/73 F |
| 1,223,834 | 3/1971 | United Kingdom | 273/73 G |

*Primary Examiner*—Richard J. Apley

*Attorney, Agent, or Firm*—Keith D. Beecher

[57] ABSTRACT

A construction for a tennis racket is provided which includes a frame formed of graphite material, or the like, which defines a loop, and a handle formed of two longitudinal sections, and composed of aluminum, or other light metal or alloy. The handle is formed of two stampings which are held together by elongated brackets extending along each side of the handle and adhesively bonded to the respective edges of the stampings. The frame has an integral neck formed at one end thereof which extends radially outwardly from the loop. The inner ends of the stampings extend over the neck and partially around the outer periphery of the frame to sandwich the frame and neck between the stampings. The stampings are also adhesively bonded to the neck and frame so that the handle is securely attached to the frame.

4 Claims, 8 Drawing Figures

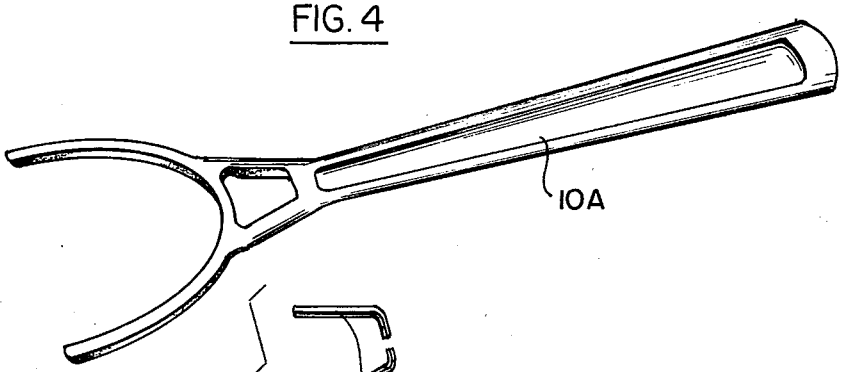
FIG. 4
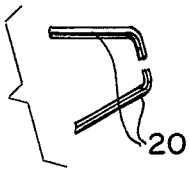
FIG. 7
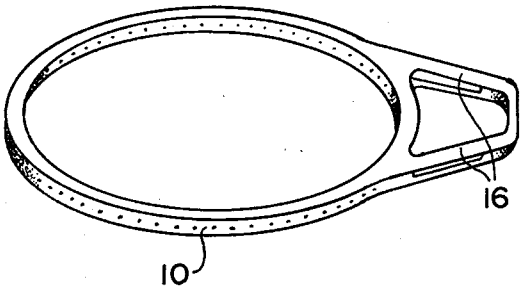
FIG. 3
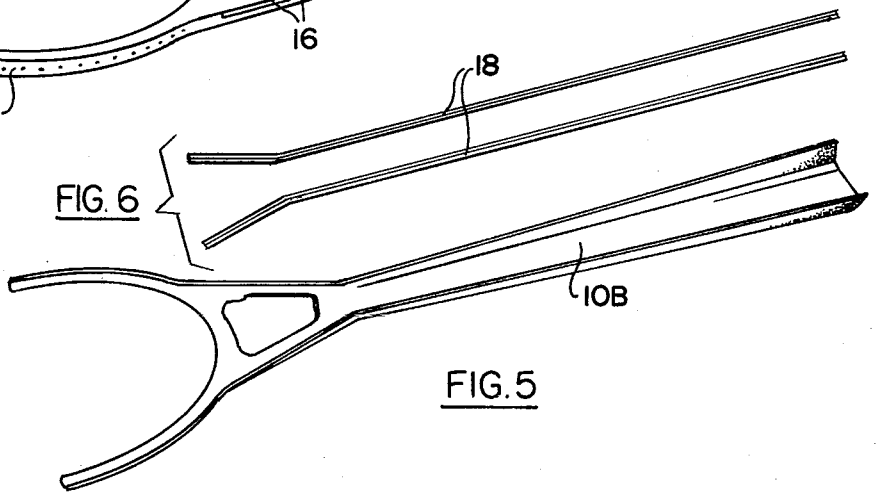
FIG. 6
FIG. 5
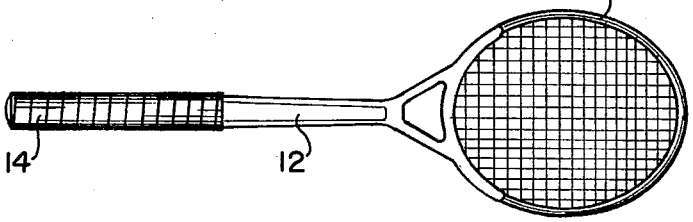
FIG. 1
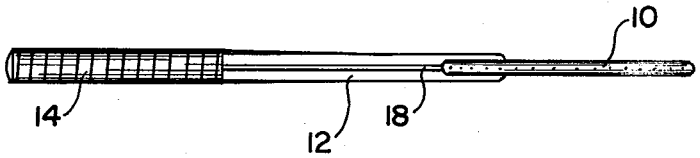
FIG. 2

TENNIS RACKET

BACKGROUND OF THE INVENTION

Graphite tennis rackets have been found to have better playing characteristics as compared with the prior art metal rackets because of the superior resilient characteristics of the graphite material. However, graphite is relatively expensive, and the cost of the prior art graphite rackets is out of the reach of most tennis players.

The construction of the present invention provides a hybrid tennis racket whose frame is composed of graphite, or the like, where the resilient properties of graphite are effective; and whose handle is composed of light inexpensive metal, such as aluminum. The handle and frame of the hybrid racket of the invention are interconnected and bonded in a simple and inexpensive manner, and the resulting hybrid racket has all the desirable playing characteristics of the more expensive prior art graphite rackets.

BRIEF DESCRIPTION OF THE DRAWINGS

FIG. 1 is a top plan view of a tennis racket constructed in accordance with the concepts of the invention;

FIG. 2 is a side view of the racket of FIG. 1;

FIG. 2A is a section taken along the line 2A—2A of FIG. 2;

FIG. 3 is a perspective representation of the frame of the racket of FIGS. 1 and 2;

FIGS. 4 and 5 are metal stampings which are fitted together to constitute the handle of the racket;

FIG. 6 illustrates a pair of elongated brackets which receive the adjacent edges of the stampings of FIGS. 4 and 5 to couple the stampings together; and FIG. 7 shows two additional brackets which fit within the neck of the racket to engage the adjacent edges of the handle sections of FIGS. 4 and 5.

DETAILED DESCRIPTION OF THE ILLUSTRATED EMBODIMENT

In the illustrated embodiment, a hybrid tennis racket is provided having a frame 10 formed of graphite, fiberglass, or other suitable material of superior resilient characteristics, and having a handle 12 formed of an appropriate metal, such as aluminum, or other equivalent light metal or metal alloy. A usual grip 14 is wrapped around the outer end of handle 12.

As best shown in FIG. 3, the frame 10 has a usual configuration to receive the strings of the racket, and it is provided with an integral neck 16 at one end, which may be formed of the same material as the frame.

The handle 12 of the racket is formed of two metal stampings, namely 10A of FIG. 4 and 10B of FIG. 5. The stampings may be stamped from flat sheets of aluminum, or other appropriate material. The seams between the stampings are closed by a pair of elongated brackets 18 which may, for example, be in the form of aluminum extrusions, and which may have an H-shape cross-section.

The brackets 18 receive the adjacent edges of the handle sections 10A and 10B as shown in FIG. 2A. The handle is fitted so that the inner ends of sections 10A and 10B extend over the neck 16, and partially around the loop formed by frame 10, as best shown in FIGS. 1 and 2. Additional brackets 20, like brackets 18, are used to close the seam between the adjacent edges of the handle sections within the confines of neck 16.

The handle sections are bonded to the brackets 18 and 20, and to the neck 16 and frame 10 by a suitable adhesive. A structural catalytic epoxy adhesive (EA9410), manufactured by the Hysol Company of Los Angeles has been used, and has been found to be most effective as a bonding agent.

The resulting tennis racket has all the characteristics of the more expensive prior art graphite rackets, but may be manufactured and sold at a fraction of the price.

It will be appreciated that while a particular embodiment of the invention has been shown and described, modifications may be made. It is intended in the claims to cover the modifications which come within the spirit and scope of the invention.

What is claimed:

1. A tennis racket comprising a frame having a loop portion and further having a co-planar integral neck portion at one end of the loop portion and extending radially outwardly from the loop portion and circumscribing an area smaller than the area circumscribed by the loop portion, and a handle comprised of two longitudinal sections formed of metal stampings, the inner ends of the two handle sections each having a configuration corresponding to the configuration of the neck portion and to the sides of the loop portion adjacent to the neck portion, said inner ends extending over the neck portion and over said sides of said loop portion of the frame adjacent to said neck portion to sandwich said neck portion and said sides of of said loop portion of said frame therebetween, said handle sections being adhesively bonded to said neck portion and to said sides of said loop portion of said frame adjacent to said neck portion.

2. The tennis racket defined in claim 1, in which the metal stampings are formed of aluminum.

3. The tennis racket defined in claim 1, in which the frame and neck portion are formed of graphite.

4. The tennis racket defined in claim 1, and which includes a pair of elongated brackets respectively enclosing the spaces between the adjacent edges of the two longitudinal handle sections, and in which the adjacent edges of the longitudinal handle sections are adhesively bonded to the brackets.

* * * * *